US008016074B2

(12) United States Patent
Black et al.

(10) Patent No.: US 8,016,074 B2
(45) Date of Patent: Sep. 13, 2011

(54) WORK PLATFORM

(75) Inventors: Phillip John Black, McConnellsburg, PA (US); Christopher A. Haught, McConnellsburg, PA (US); Ignacy Puszkiewicz, Smithsburg, MA (US)

(73) Assignee: JLG Industries, Inc., McConnellsburg, PA (US)

( * ) Notice: Subject to any disclaimer, the term of this patent is extended or adjusted under 35 U.S.C. 154(b) by 467 days.

(21) Appl. No.: 12/327,324

(22) Filed: Dec. 3, 2008

(65) Prior Publication Data

US 2010/0133043 A1 Jun. 3, 2010

(51) Int. Cl.
*E04G 5/14* (2006.01)

(52) U.S. Cl. ..... 182/113; 182/2.1; 182/2.2; 182/148

(58) Field of Classification Search ..... 182/2.1, 182/2.2, 63.1, 113, 148
See application file for complete search history.

(56) References Cited

U.S. PATENT DOCUMENTS

| | | | | |
|---|---|---|---|---|
| 4,185,716 | A * | 1/1980 | Rinehart | 182/2.5 |
| 4,787,111 | A * | 11/1988 | Pacek et al. | 14/71.1 |
| 5,069,309 | A * | 12/1991 | Swiderski et al. | 182/119 |
| 5,154,569 | A * | 10/1992 | Eryou et al. | 414/495 |
| 5,803,204 | A * | 9/1998 | White et al. | 182/148 |
| 6,471,004 | B2 * | 10/2002 | Stringer et al. | 182/148 |
| 6,823,964 | B2 * | 11/2004 | Goode | 182/3 |
| 2010/0200332 | A1 * | 8/2010 | Bowden | 182/113 |
| 2010/0294592 | A1 * | 11/2010 | Crook et al. | 182/113 |

FOREIGN PATENT DOCUMENTS

| | | |
|---|---|---|
| WO | WO 97/15522 | 5/1997 |

* cited by examiner

*Primary Examiner* — Katherine Mitchell
*Assistant Examiner* — Johnnie A Shablack
(74) *Attorney, Agent, or Firm* — Nixon & Vanderhye P.C.

(57) ABSTRACT

A platform for an aerial lift enables unobstructed access to a work area adjacent the platform. The platform includes a floor structure with front and rear sides and ends, and a safety rail disposed along at least the front side. The safety rail includes an entry gate. A lift gate is pivotably attached to the safety rail and pivotable between a closed position and an open position. The lift gate includes a gate rail extending along the rear side of the floor structure and a pair of lift rails connected between the gate rail and the safety rail. The gate rail is pivotable relative to the lift rails between an extended position and a retracted position. In this manner, the lift gate can be raised without the gate rail impacting the work surface.

20 Claims, 6 Drawing Sheets

WORK PLATFORM

CROSS-REFERENCES TO RELATED APPLICATIONS (NOT APPLICABLE)

STATEMENT REGARDING FEDERALLY SPONSORED RESEARCH OR DEVELOPMENT (NOT APPLICABLE)

BACKGROUND OF THE INVENTION

The present invention relates to work platforms and, more particularly, to a work platform enabling unobstructed access to a work surface.

Lift vehicles including aerial work platforms and telehandlers such as rough terrain fork trucks are known and typically include an extendible boom, which may be positioned at different angles relative to the ground, and a work platform at an end of the extendible boom. On or adjacent the platform, there is typically provided a control console including various control elements that may be manipulated by the operator to control such functions as boom angle, boom extension, rotation of the boom and/or platform on a vertical axis, and where the lift vehicle is of the self-propelled type, there are also provided engine, steering and braking controls.

Due to the nature of such work platforms being elevated in use, there is typically a safety rail disposed about a perimeter of the platform with an entry gate that permits operator access to the platform. It is desirable in certain working scenarios to enable the operator to have unobstructed access to a work area, e.g., where the safety rail is a hindrance to work area access. An example of such a work area may be a vertical wall. In some instances, if the platform is close enough to the vertical wall or the like that a safe working condition can be maintained even without a safety rail at the portion of the platform facing the wall or other work area. Another example is an angled or horizontal roof surface, where the work to be done is just beyond the floor of the platform, and where fixed safety rail systems would inhibit or obstruct certain roofing installation or repair efforts.

BRIEF SUMMARY OF THE INVENTION

The platform proposed herein includes a lift gate that works in conjunction with the safety rail. The lift gate, upon satisfying certain safety criteria, can be pivoted to an open position that enables unobstructed access to the work area. Since the platform would necessarily be close to the wall or other work area, the lift gate is structured to avoid interference with the wall or other work area when the lift gate is pivoted from its closed position to an open position. A number of safety features prevent the gate from being opened until it is determined that a safe working condition exists.

In an exemplary embodiment of the invention, a platform for an aerial lift includes a floor structure having a front side, a rear side and ends, and a safety rail disposed along at least the front side of the floor structure. The safety rail has an entry gate at the front side. A lift gate is pivotably attached to the safety rail and pivotable between a closed position and an open position. The lift gate includes a gate rail extending along the rear side of the floor structure and a pair of lift rails connected between the gate rail and the safety rail, where the gate rail is pivotable relative to the lift rails between an extended position and a retracted position. The gate rail may be biased toward the retracted position. The safety rail preferably comprises one or two entry gates at the front side of the platform.

One or two primary gas struts may be affixed between at least one of the lift rails and the safety rail, which aids in pivoting the lift gate between the closed and open positions. A secondary gas strut may additionally be affixed between at least one of the lift rails and the gate rail, which urges the gate rail toward the retracted position.

A proximity sensor possibly housed in the rear side of the floor structure detects a structure within a predefined distance of the platform. In this context, the platform may additionally include a lift gate lock that normally locks the lift gate in the closed position, and a controller/position sensor in communication with the lift gate lock and the proximity sensor(s). The controller/position sensor permits the releases of the lift gate lock according to a signal from the proximity sensor(s). The platform may still additionally include at least one safety system, such as a function enable switch and/or a manual unlock button, to effect lift gate release that is redundant to the proximity sensor signal.

In one arrangement, the safety rail comprises an end rail disposed along at least one of the floor structure ends. The end rail and gate rail are relatively positioned such that the end rail displaces the gate rail from the retracted position to the extended position when the lift gate is pivoted from the open position to the closed position. The end rail serves to maintain the gate rail in the extended position with the lift gate in the closed position. The gate rail is held in the extended position against the bias when the lift gate is in the closed position, and the gate rail is configured to shift toward the retracted position as the lift gate is pivoted toward the open position.

In another exemplary embodiment of the invention, a lift vehicle including a vehicle chassis is provided with the work platform. The lift vehicle may include a drive system for driving operations of the vehicle, and a control implement disposed on the aerial work platform and controlling operation of the drive system. In this context, when the lift gate is pivoted to the open position, the control implement is limited or disabled.

In yet another exemplary embodiment of the invention, a method of providing unobstructed access to a work area from a platform includes the steps of providing a signal from the proximity sensor(s) that the platform is disposed a predefined distance from the work area; and pivoting the lift gate from the closed position to the open position and concurrently pivoting the gate rail relative to the lift rails toward the retracted position to thereby avoid contact with the work area as the lift gate is pivoted toward the open position.

In still another exemplary embodiment of the invention, a lift gate is cooperable with a work platform and a platform safety rail and pivotable between a closed position and an open position. The lift gate includes a gate rail extending along a rear side of the work platform and a pair of lift rails connectable between the gate rail and the safety rail. The gate rail is pivotable relative to the lift rails between an extended position and a retracted position.

BRIEF DESCRIPTION OF THE DRAWINGS

These and other aspects and advantages of the present invention will be described in detail with reference to the accompanying drawings, in which.

DETAILED DESCRIPTION OF THE INVENTION

Figure 1:
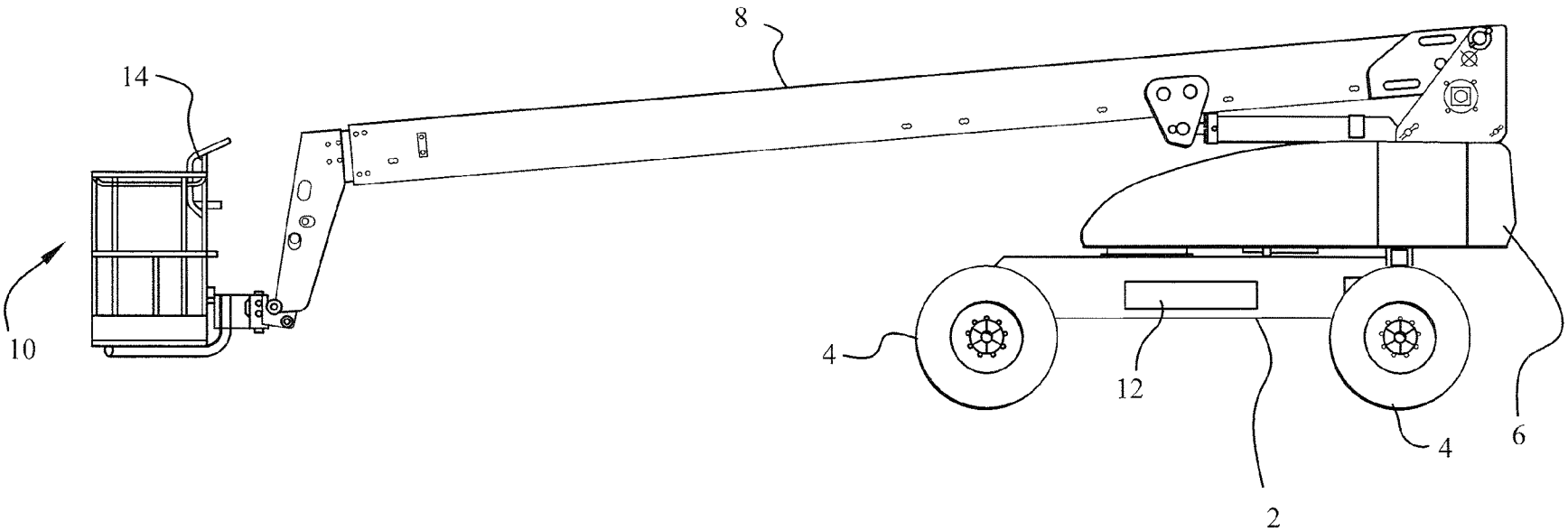
FIG. 1 illustrates an exemplary lift vehicle.

FIG. 1 illustrates an exemplary typical aerial lift vehicle including a vehicle chassis 2 supported on vehicle wheels 4. A turntable and counterweight 6 are secured for rotation on the chassis 2, and an extendible boom assembly is pivotably attached at one end to the turntable 6. An aerial work platform 10 is attached at an opposite end of the extendible boom 8. The illustrated lift vehicle is of the self-propelled type and thus also includes a driving system (illustrated schematically in FIG. 1 at 12) and a control console 14 on the platform 10 with various control elements that may be manipulate d by the operator to control such functions as boom angle, boom extension, rotation of the boom and/or platform on a vertical axis, an engine, steering and braking controls, etc.

FIGS. 2-5 show more detailed views of an exemplary work platform 10 of the present invention. Generally, the platform 10 includes a floor structure 16 having a front side 18, a rear side 20 and ends 22. A safety rail 24 is disposed along at least the front side 18 of the floor structure 16. As shown, however, the safety rail 24 also extends along the ends 22. The safety rail 24 additionally includes at least one and preferably two entry gates 26.

Figure 2:
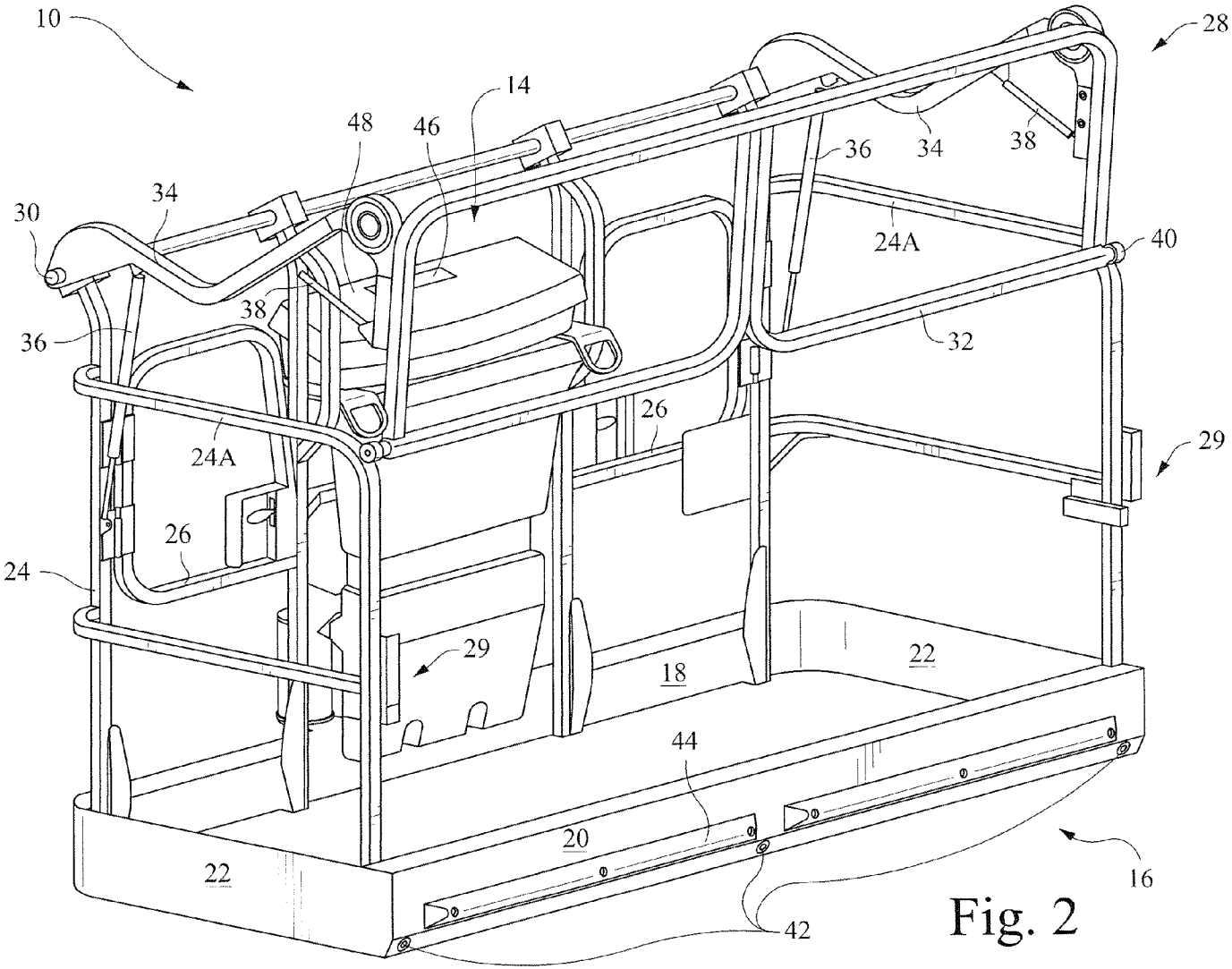
FIG. 2 is a perspective view of the platform according to an exemplary embodiment of the invention.
Figure 3:
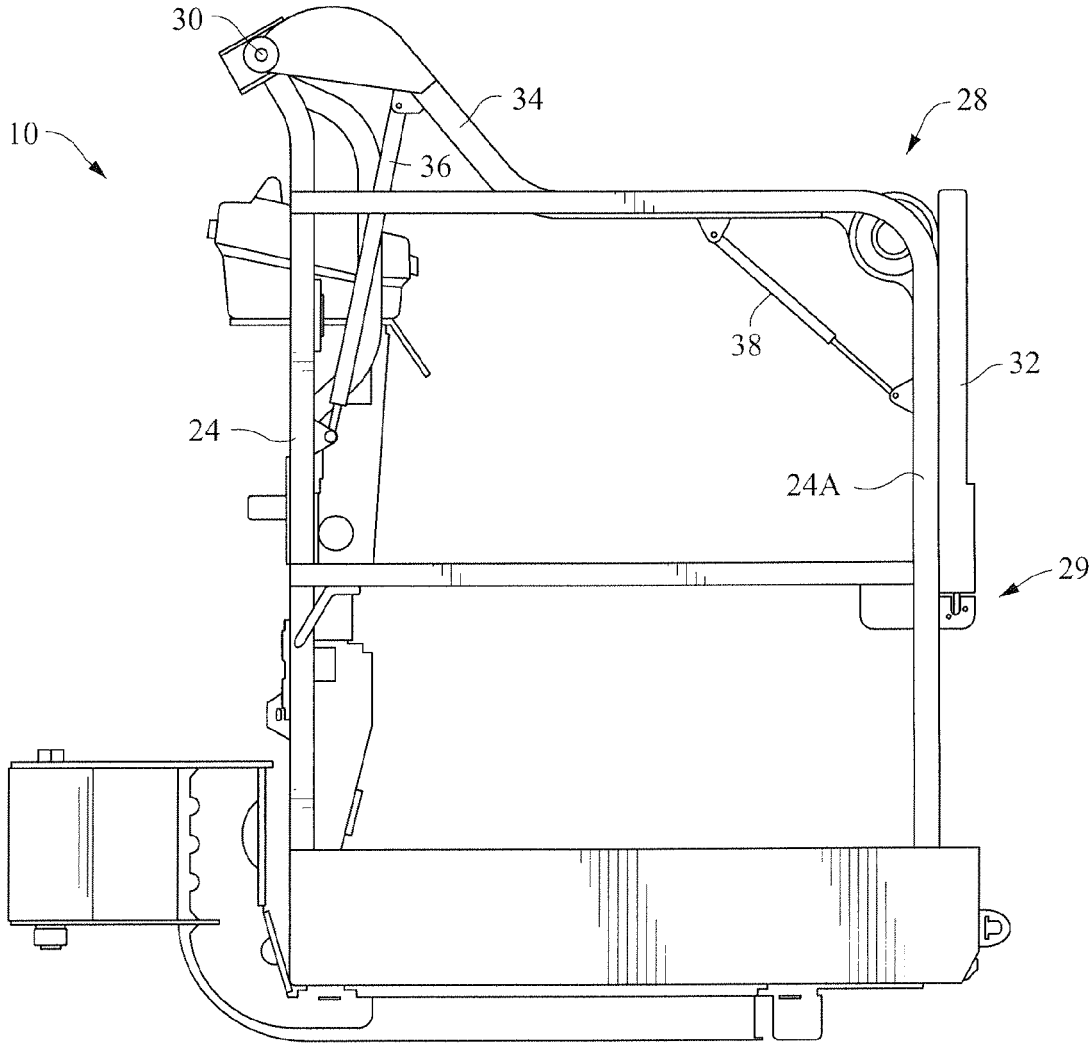
FIG. 3 is a side view thereof.
Figure 4:
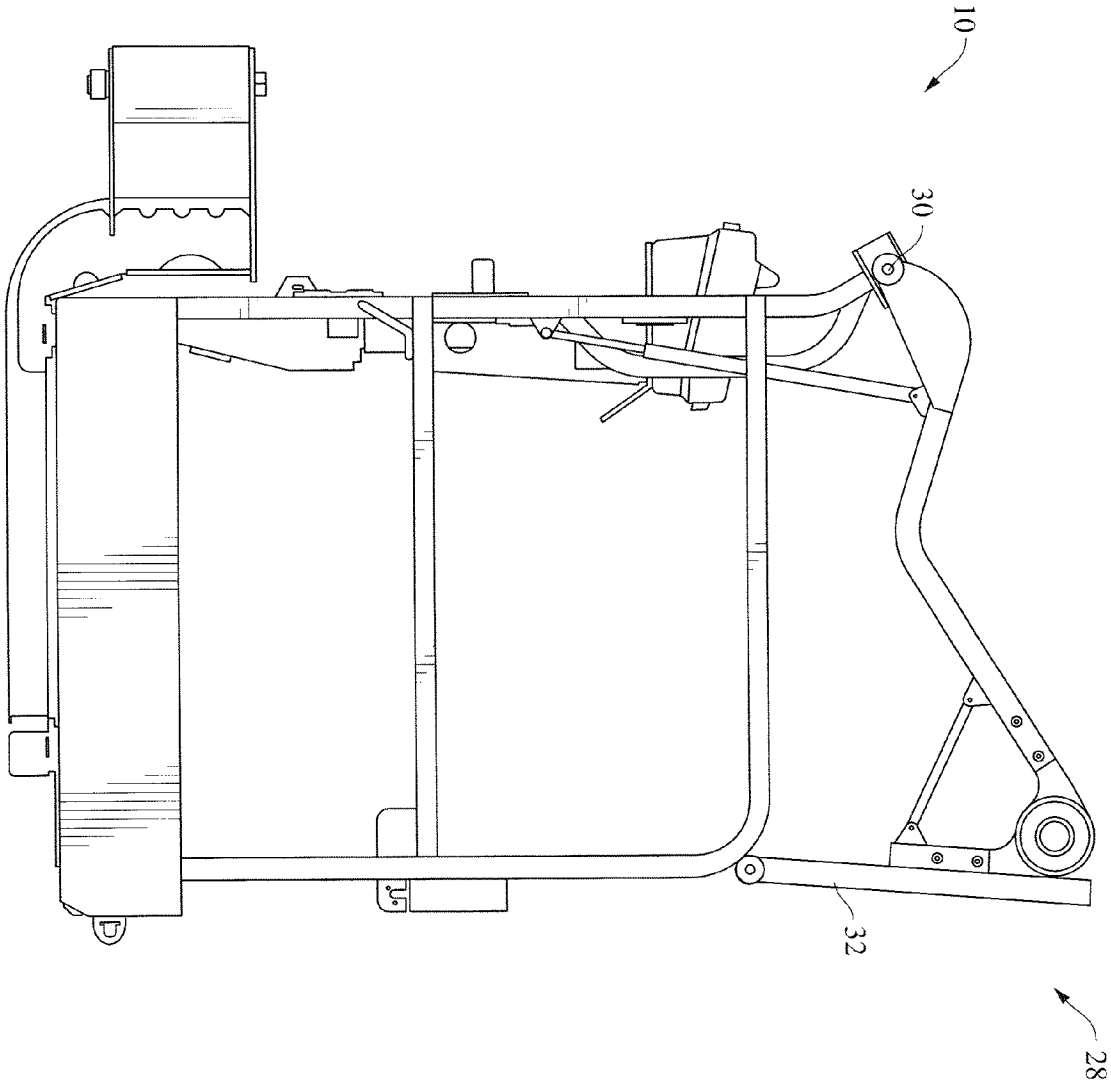
FIG. 4 is a side view with the lift gate between its closed and open positions.
Figure 5:
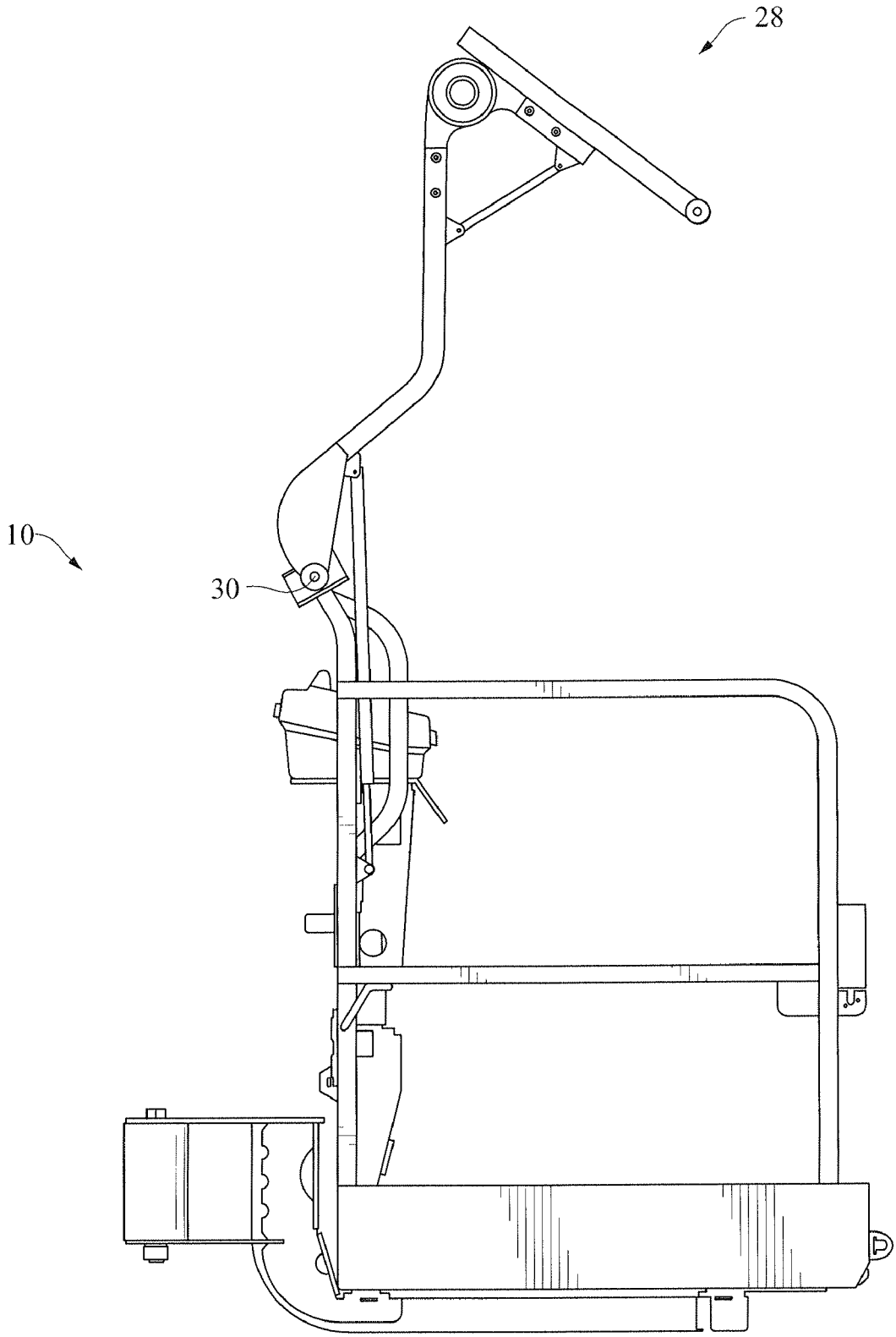
FIG. 5 is a side view with the lift gate in its open position.

The platform 10 additionally includes a lift gate 28 pivotably attached to the safety rail 24 at pivot points 30 defined generally at the intersection of the floor structure front side 18 and ends 22. The lift gate 28 is pivotable between a closed position as shown in FIG. 3 and an open position as shown in FIG. 5. FIGS. 2 and 4 show the lift gate 28 in an intermediate position between the open and closed positions.

The lift gate 28 includes a gate rail 32 that in the closed position extends along the rear side 20 of the floor structure 16. As seen with reference to FIGS. 2 and 3, with the lift gate 28 in the closed position, the gate rail 32 functions as a safety rail for the rear side 20 of the platform. The lift gate 28 also includes a pair of lift rails 34 connected between the gate rail 32 and the safety rail 24. The gate rail 32 is pivotable relative to the lift rails 34 between an extended position as shown in FIG. 3 and a retracted position as shown in FIG. 5.

To facilitate opening and closing the lift gate 28, a primary gas strut 36 is affixed between at least one of the lift rails 34 and the safety rail 24. As shown, the platform preferably includes two primary gas struts 36. The primary gas struts 36 are positioned and configured to push upward on the lift gate 28 with a force that is slightly less than a downward force provided by the lift gate weight in the closed position. As the lift gate 28 is pivoted to its open position (FIG. 5), the downward force of the lift gate 28 due to its weight is reduced, and the gas struts 36 can support and hold the lift gate 28 in the open position.

A secondary gas strut 38, preferably two, is affixed between the lift rails 34 and the gate rail 32. The secondary gas struts 38 operate in a compression mode and serve to bias the gate rail 32 toward the retracted position. That is, as seen in FIG. 3, the secondary gas strut 36 is extended and the gate rail 32 is held in its extended position generally perpendicular to the lift rail 34 by an end rail portion 24*a* of the safety rail 24. As the lift gate 28 is pivoted toward its open position (see FIGS. 2 and 4), the secondary gas strut 38 retracts and pulls the gate rail 32 toward its retracted position. A length of the secondary gas struts 38 is set so that the end rails 24*a* displace the gate rail 32 from the retracted position back to the extended position when the lift gate 28 is pivoted from the open position to the closed position. Rollers 40 or the like may be suitably located on the gate rail 32 to assist in repositioning the gate rail 32 relative to the end rails 24*a* of the safety rail 24.

The platform may also include one or more proximity sensors 42 that are housed within a bumper 44 and face away from the rear side 20 of the floor structure 16. As shown in FIG. 2, the platform preferably includes three sensors 42, although more or fewer sensors could be utilized. The proximity sensors 42 detect a structure within a predefined distance of the platform. The type of sensor 42 is not pertinent to the invention as many suitable sensors are available. One preferred sensor is an ultrasonic sensor.

Figure 6:
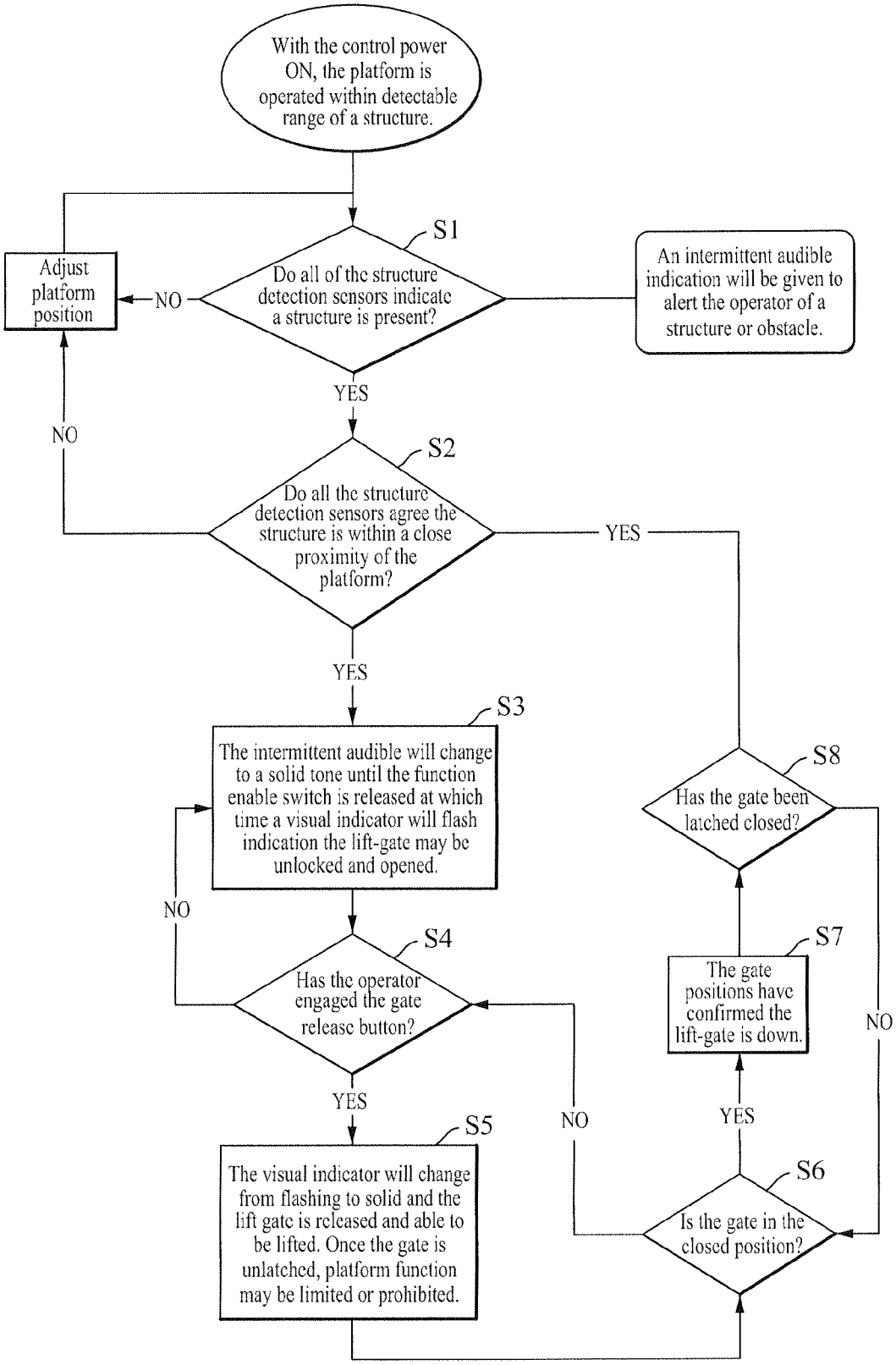
FIG. 6 is a flow chart of the lift gate control logic.

As noted, the control console 14 houses control implements for operation of the lift vehicle. The control console 14 also contains a controller 46 that controls operation of the lift gate 28 and gate locks 29. The lift gate locks 29 normally lock the lift gate 28 in the closed position. The controller 46 releases the lift gate locks 29 according to signals from the proximity sensors 42. That is, if the controller 46 determines that the platform is close enough to a structure that the lift gate 28 can be pivoted to its open position while maintaining a safe working environment for the operator, the controller will then release the lift gate locks 29. The controller also incorporates at least one safety system to effect lift gate release that is redundant to the proximity sensors 42. For example, the redundant safety system may be one of a function enable switch (such as a foot switch) or a manual unlock button 48, The operation of the lift gate and its control logic will be described with reference to FIG. 6. In operation, as an operator approaches the desired structure, such as a vertical wall, the controller 46 energizes a "platform position alarm" so that the operator will hear an intermittent beep as an indication that the proximity sensors 42 are detecting an obstacle or structure. As noted, the lift gate 28 is normally locked by the lift gate lock. Once the platform has been positioned so that the controller 46 determines that a predefined distance threshold such as 3.5", has been satisfied and all sensors indicate that a structure is present (step S 1 and step S2), the controller 46 changes the "platform position alarm" to a solid beep as an indication that the platform is positioned close enough to the desired structure. In one arrangement, the operator may then be required to release the function enable switch, whereupon the controller 46 will stop the "platform position alarm" from sounding and flash a "lift gate unlocked indicator" on the control console 14 as an indication that the lift gate 28 is now safe to be released (step S3).

With the operator off of the function enable switch and the "lift gate unlocked indicator" flashing on the platform control console 14, the operator may be required to press the "unlock gate latch" button 48 to release the electric gate latches (step S4). Once the "unlock gate latch" button 48 has been engaged, a "lift gate unlocked indicator" will change from flashing to ON, the electric latches will release the lift gate 28, and all vehicle motion functions from the platform will be disabled or limited (step S5). If the operator attempts to operate a function with the gate open, the controller will sound an alarm when the function enable switch is engaged and flash a fault code. Finally, as the lift gate is manually raised by the operator, the proximity sensors 42 will turn OFF, the controller 46 will turn off the "lift gate unlocked indicator," and the electric latches will be reset to receive, latch and lock the gated railing when the gate is closed.

In a typical operating position, the bumper 44 may actually contact the surface on which the operator intends to work. By virtue of the configuration of the lift gate 28 including the gate rail 32 that is pivotable relative to the lift rails 34 and bias toward their retracted position by the gas springs 38, the lift gate avoids contact with the work area or vertical wall in the lifting process.

As the operator manually lifts the lift gate 28, the primary gas springs 36 begin to assist with the lifting duty. At an intermediate point between the closed position and the open position of the lift gate 28, the gas springs 36 exert enough force on the lift gate 28 to effect self-rising of the lift gate 28. Concurrently, the secondary gas springs 38 continuously pivot (pull) the gate rail 32 toward the retracted position. With the lift gate 28 in the open position, the operator is provided full unobstructed access to the work area. When the tasks are completed, the operator can then manually pull the lift gate 28 from the open position toward the closed position against the force of the gas springs 36. The lift gate 28 must be closed and relatched for platform functions to be fully enabled. With the lift gate in the closed position, the proximity sensors 42 will close indicating that the lift gate is down, and the "electric latch status" input will indicate that the gate latches are closed and locked (steps S6, S7 and S8). Finally, the controller 46 will re-evaluate the proximity sensor feedback to verify that the distance threshold is still acceptable (step S2). If so, then the controller 46 will flash the "lift gate unlocked" indicator on the platform control console 14 as an indication that the lift gate 28 is still safe to release and open.

As noted, the platform is preferably equipped with ultrasonic sensors capable of detecting the presence of the ground or a structure. The sensors preferably will detect the ground or structure when the platform is within a safe distance (e.g., 6"-9") of the structure. The system is preferably configured to require that all of the ultrasonic sensors agree that the platform is positioned within the distance threshold. In the event one or more of the sensors fails to detect the ground or structure, the control system. 46 will not permit the electric latch to release the lift gate 28 at any time, While the invention has been described in connection with what is presently considered to be the most practical and preferred embodiments, it is to be understood that the invention is not to be limited to the disclosed embodiments, but on the contrary, is intended to cover various modifications and equivalent arrangements included within the spirit and scope of the appended claims.

The invention claimed is:

1. A platform for an aerial lift comprising:

a floor structure having a front side, a rear side and ends;

a safety rail disposed along at least the front side of the floor structure, the safety rail including an entry gate at the front side; and a lift gate pivotably attached to the safety rail and pivotable between a closed position and an open position, the lift gate including a gate rail extending along the rear side of the floor structure and a pair of lift rails connected between the gate rail and the safety rail, wherein the gate rail is pivotable relative to the lift rails between an extended position and a retracted position.

2. A platform according to claim 1, wherein the safety rail comprises two entry gates at the front side.

3. A platform according to claim 1, further comprising a lift gate lock that normally locks the lift gate in the closed position.

4. A platform according to claim 1, further comprising a primary gas strut affixed between at least one of the lift rails and the safety rail, the primary gas strut aiding in pivoting the lift gate between the closed and open positions.

5. A platform according to claim 4, further comprising a pair of primary gas struts, one each affixed between each of the lift rails and the safety rail.

6. A platform according to claim 4, further comprising a secondary gas strut affixed between at least one of the lift rails and the gate rail, the secondary gas strut urging the gate rail toward the retracted position.

7. A platform according to claim 1, wherein the gate rail is biased toward the retracted position.

8. A platform according to claim 7, wherein the safety rail comprises an end rail disposed along at least one of the floor structure ends, and wherein the end rail and gate rail are relatively positioned such that the end rail displaces the gate rail from the retracted position to the extended position when the lift gate is pivoted from the open position to the closed position, the end rail maintaining the gate rail in the extended position with the lift gate in the closed position.

9. A platform according to claim 7, wherein the gate rail is held in the extended position against the bias when the lift gate is in the closed position, and wherein the gate rail is configured to shift toward the retracted position as the lift gate is pivoted toward the open position.

10. A platform according to claim 1, further comprising a proximity sensor facing away from the rear side of the floor structure, the proximity sensor detecting a structure within a predefined distance of the platform.

11. A platform according to claim 10, further comprising a bumper affixed to the rear side of the floor structure and housing the proximity sensor.

12. A method of providing unobstructed access to a work area from the platform of claim 10, the method comprising:

providing a signal from the proximity sensor that the platform is disposed a predefined distance from the work area; and pivoting the lift gate from the closed position to the open position and concurrently pivoting the gate rail relative to the lift rails toward the retracted position to thereby avoid contact with the work area as the lift gate is pivoted toward the open position.

13. A platform according to claim 10, further comprising a lift gate lock that normally locks the lift gate in the closed position, and a controller in communication with the lift gate lock and the proximity sensor, wherein the controller releases the lift gate lock according to a signal from the proximity sensor.

14. A platform according to claim 13, further comprising at least one safety system to effect lift gate release that is redundant to the proximity sensor signal.

15. A platform according to claim 14, wherein the redundant safety system is at least one of a function enable switch and a manual unlock button.

16. A lift vehicle comprising:

a vehicle chassis; and an aerial work platform coupled with the vehicle chassis, the aerial work platform comprising:

a floor structure having a front side, a rear side and ends.

a safety rail disposed along at least the front side of the floor structure, the safety rail including an entry gate at the front side, and a lift gate pivotably attached to the safety rail and pivotable between a closed position and an open position, the lift gate including a gate rail extending along the rear side of the floor structure and a pair of lift rails connected between the gate rail and the safety rail, wherein the gate rail is pivotable relative to the lift rails between an extended position and a retracted position.

17. A lift vehicle according to claim 16, further comprising:

a drive system for driving operations of the vehicle; and a control implement disposed on the aerial work platform and controlling operation of the drive system, wherein when the lift gate is pivoted to the open position, the control implement is limited or disabled.

18. A lift gate cooperable with a work platform and a platform safety rail and pivotable between a closed position and an open position, the lift gate comprising a gate rail extending along a rear side of the work platform and a pair of lift rails connectable between the gate rail and the safety rail, wherein the gate rail is pivotable relative to the lift rails between an extended position and a retracted position.

19. A lift gate according to claim 18, wherein the gate rail is biased toward the retracted position.

20. A platform for an aerial lift comprising:

a floor structure having a front side, a rear side and ends;

a safety rail disposed along the front side and the ends of the floor structure, the safety rail including a pair of entry gates at the front side;

a lift gate pivotably attached to the safety rail via a primary gas spring and pivotable between a closed position and an open position, the lift gate including a gate rail extending along the rear side of the floor structure and a pair of lift rails connected between the gate rail and the safety rail, wherein the gate rail is pivotably attached to the lift rails via a secondary gas spring and pivotable between an extended position and a retracted position;

a proximity sensor facing away from the rear side of the floor structure, the proximity sensor detecting a structure within a predefined distance of the platform;

a lift gate lock that normally locks the lift gate in the closed position; and a controller in communication with the lift gate lock and the proximity sensor, wherein the controller releases the lift gate lock according to a signal from the proximity sensor.

* * * * *